United States Patent [19]

Brown

[11] 4,413,777

[45] Nov. 8, 1983

[54] RAIL CLIP AND AN ASSEMBLY ON A RAILWAY TRACK WHICH INCLUDES THE CLIP

[75] Inventor: Trevor P. Brown, Orpington, England

[73] Assignee: Pandrol Limited, London, England

[21] Appl. No.: 299,953

[22] Filed: Sep. 8, 1981

[30] Foreign Application Priority Data

Sep. 29, 1980 [GB] United Kingdom ..... 8031392

[51] Int. Cl.[3] ..... E01B 9/48

[52] U.S. Cl. ..... 238/349; 238/338

[58] Field of Search ..... 238/310, 315, 338, 349, 238/351

[56] References Cited

U.S. PATENT DOCUMENTS

| | | | |
|---|---|---|---|
| 4,073,435 | 2/1978 | Miller | 238/349 |
| 4,190,200 | 2/1980 | Morrow | 238/349 |

FOREIGN PATENT DOCUMENTS

| | | | |
|---|---|---|---|
| 7813 | 2/1980 | European Pat. Off. | 238/349 |
| 2715145 | 10/1977 | Fed. Rep. of Germany | 238/349 |
| 869385 | 5/1961 | United Kingdom | 238/349 |
| 1519349 | 7/1978 | United Kingdom | 238/349 |
| 2085057 | 4/1982 | United Kingdom | 238/349 |

*Primary Examiner*—Randolph Reese

*Attorney, Agent, or Firm*—Charles A. Blank

[57] ABSTRACT

A rail clip consists of a bent rod having, proceeding from a first end of the rod to the other end, a first portion which is straight, a second portion which is a reverse bend, a third portion beside the first portion, a fourth portion which is a reverse bend and finally a fifth portion beside the first portion. When the clip is in a defined position a section of the fourth portion lies vertically above and crosswise over the axis of the first portion and when the clip is viewed from above the third and fifth portions appear to be on opposite sides of the first portion. On the under-side of the third portion is a step having a rising face which faces away from the first end of the rod. This face co-operates with a stop on a seat for the third portion of the clip, to prevent unauthorized removal of the clip. The stop and seat are on an anchorage which provides a passageway, into which the first portion of the clip is driven, parallel to the length of the flange of a railway rail on which the fifth portion of the clip bears.

9 Claims, 10 Drawing Figures

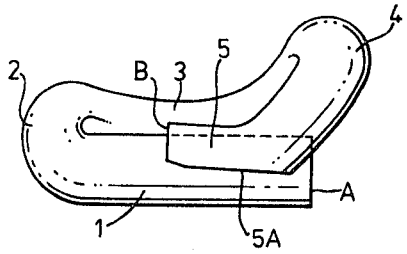
FIG. 1.
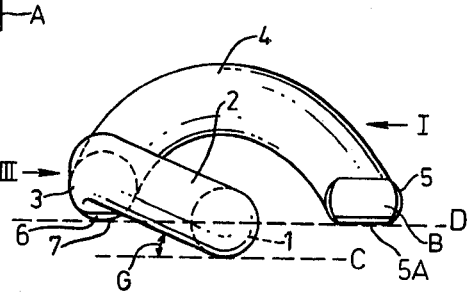
FIG. 2.
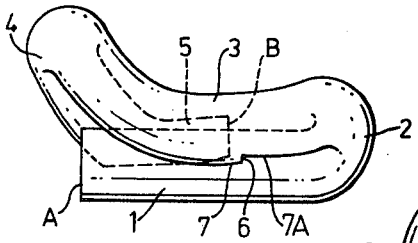
FIG. 3.
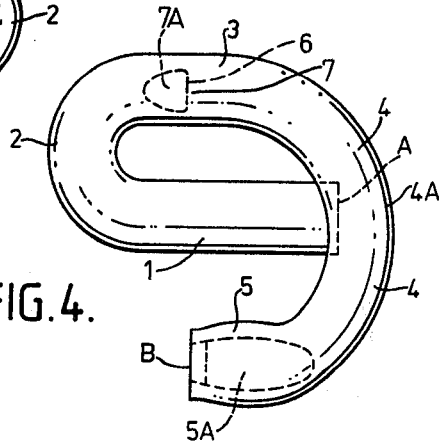
FIG. 4.
FIG. 5.
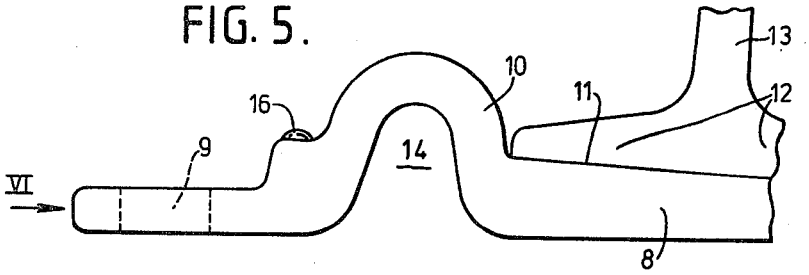

FIG. 6.
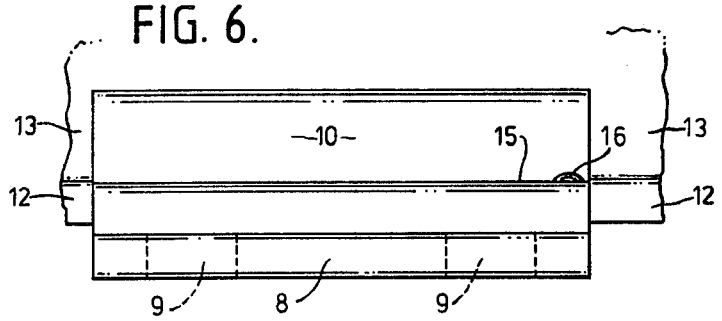
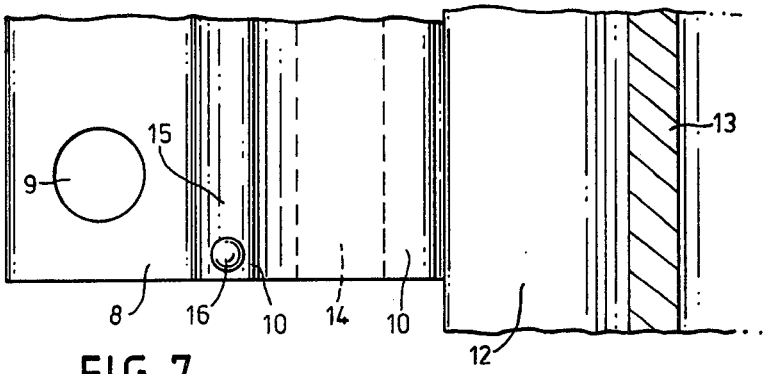
FIG. 7.
FIG. 8.
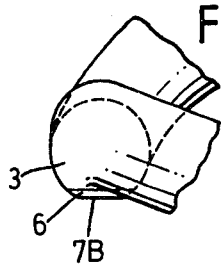
FIG. 9.
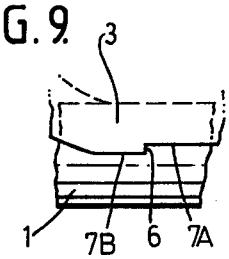
FIG. 10.
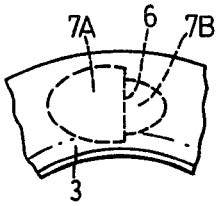

RAIL CLIP AND AN ASSEMBLY ON A RAILWAY TRACK WHICH INCLUDES THE CLIP

This invention relates to a rail clip, for holding down a railway rail, comprising a rod of resilient metal, at least 8 mm. thick, which has been bent so that it comprises, proceeding from one end of the rod to the other end, a first portion which constitutes a substantially straight leg, a second portion in the form of a reverse bend, a third portion beside the first portion, a fourth portion in the form of a reverse bend and then a fifth portion which terminates at said other end of the rod and is beside the first portion, the configuration being such that when the clip is in a position (which is called below "the defined position") in which the first portion is horizontal and the lowest points at opposite ends of the first portion lie in the same horizontal plane as one another and the lowest points on the third and fifth portions lie in the same horizontal plane as one another, a section of the fourth portion lies vertically above and cross-wise over the axis of the first portion and when the clip is viewed from above the third and fifth portions appear to be on opposite sides of the first portion. A clip according to this definition is referred to below as a "P-R" clip; it was invented by Pande-Rolfsen—see his U.S. Pat. No. 3,004,716, which shows an elementary form of P-R clip, and U.S. Pat. No. 3,297,253 (Astley et al), which shows in FIGS. 1 to 3 a form of P-R clip of which tens of millions have been made and sold.

The present invention is concerned with the problem of making it difficult for unauthorized persons to remove P-R clips from their positions in a railway track.

According to a first aspect of the invention, there is provided a P-R clip having, on the underside of the third portion of the clip when the clip is in the defined position, a step having a rising face which faces away from said one end of the rod.

According to a second aspect of the invention, there is provided an assembly on a railway track comprising a railway rail, an anchorage which affords a passageway beside the rail and substantially parallel to the length of it and a clip according to the first aspect of the invention, the first portion of which has been driven, with said one end of the rod foremost, into the passageway, the third portion of which bears downwardly on a seat which, as seen from the rail, is beyond the passageway and the fifth portion of which bears downwardly on the top of the flange of the rail, said rising face on the clip facing a stop on said seat, the assembly being such that on any attempt to remove the clip solely by hammer blows in the direction opposite to that in which the first portion of the clip has been driven into the passageway, said rising face on the clip abuts said stop so that such removal of the clip is prevented.

The rising face on the clip is preferably vertical or nearly vertical, although it may be inclined by quite a large angle to the vertical if the surface, on the stop, which it is to abut is vertical or nearly vertical. In a preferred form of the seat, however, the stop is formed by a blob of weld on the seat and so the last-mentioned surface is far from vertical. The height of the step is preferably no more than is required in order to prevent withdrawal of the clip, i.e. preferably less than 4 mm., for example about 2 mm.

The clip may be a particular form of P-R clip which is known as an e-clip, which means that the length of the rod from which the clip is made is less than 18 times its thickness (i.e. its diameter if the rod is of circular cross-section) and/or the clip is such that in the defined position the second portion of the clip, proceeding from the first portion to the third portion, has a rising part followed by a falling part and when the clip is viewed in a horizontal direction parallel to a straight line passing through the lowermost points on the opposite ends of the first portion, said rising part of the second portion is seen to be inclined to the horizontal by, everywhere, less than 45° (see British Patent Specification No. 1,510,224).

The anchorage, which anchors the first portion of the clip, could be a base plate on which the rail stands or a cast member substantially as shown in FIGS. 7 to 9 of Specification No. 1,510,224. The fifth portion of the clip could bear directly on the top of the rail flange or on an electrical insulator placed on the top of the rail flange, for example as shown in FIGS. 7 to 9 of Specification No. 1,510,224. In either case the lower surface of the fifth portion could be flat.

In the accompanying drawings:

FIG. 1 shows a side view of a rail clip according to the first aspect of the invention, taken as indicated by the arrow I in FIG. 2, FIG. 2 shows an end view of the same clip, FIG. 3 shows a side view of the same clip, taken as indicated by the arrow III in FIG. 2, FIG. 4 shows a plan view of the same clip, FIG. 5 shows an end view of a railway rail standing on a base plate, FIG. 6 shows a side view of the rail and base plate, taken as indicated by the arrow VI in FIG. 5, FIG. 7 shows a plan view of the rail and base plate, and FIGS. 8 to 10 show, by views corresponding to parts of FIGS. 2, 3 and 4, respectively, a modification of the clip shown in FIGS. 1 to 4.

The clip shown in FIGS. 1 to 4 is made by bending a rod of resilient steel of circular cross-section and 20 mm. diameter so that it has, proceeding from the end A to the end B, a first portion 1 which starts at the end A and constitutes a straight leg, a second portion 2 in the form of a reverse bend, a third portion 3 beside the first portion 1, a fourth portion 4 in the form of another reverse bend and then a fifth portion 5 which is beside the first portion 1 and terminates at the end B of the rod. When the clip is in a particular position (referred to below as "the defined position") the first portion 1 is horizontal and the lowest points at opposite ends of the first portion lie in the same horizontal plane C (see FIG. 2) and the lowest points on the third and fifth portions lie in another and higher horizontal plane D, although the planes C and D could coincide or the plane D could be lower than the plane C. In the defined position of the clip, a section 4A of the portion 4 lies vertically above and cross-wise over the axis of the first portion 1 and when the clip is viewed from above the third and fifth portions 3 and 5 appear to be on opposite sides of the first portion 1.

On the underside of the third portion 3 of the clip, when the clip is in the defined position, there is a step comprising an almost vertical rising face 6 which is planar and about 2 mm. high. The face 6 is on one side of a projection 7 on the portion 3 of the clip and it faces away from the end A of the rod.

On the underside of the fifth portion 5 of the clip there is a horizontal flat surface 5A and there is another flat horizontal surface 7A extending a short distance from the face 6 towards the second portion 2 of the clip.

FIGS. 5 to 7 show a rolled steel base plate 8 which stands on a wooden railway sleeper (not shown) and is secured to it by screwspikes (not shown) passing through four holes 9 through the base plate. The base plate comprises two ribs 10 (only one of which is shown) between which is a seating 11 on which stands a railway rail having a flange 12 and a web 13. Each rib 10 affords a passageway 14 which is beside the rail flange and parallel to the length of the rail and into each passageway 14 there is driven the portion 1 of a clip according to FIGS. 1 to 4. The clips are driven in opposite directions, in each case with the end A foremost, until they reach their final positions, in which the flat surfaces 5A of the clips are in contact with and parallel to the upper surface of the rail flange, on opposite sides of the web 13, and the third portions 3 bear downwardly on seats 15 on the base plate, which seats are beyond the passageways 14, as seen from the rail. Before reaching these positions, however, the projections 7 ride over projections 16 formed on the seats 15 by applying a blob of weld material to the seats. The projections 7 snap down behind the projections 16, the faces 6 then facing the projections 16 which form stops in that if a vandal, thief or some other unauthorized person tries to remove the slips solely by striking them with a hammer so that they tend to move in the directions opposite to those in which they were driven into their operative positions, the faces 6 will abut the projections 16 and prevent the unauthorized removal. An authorized person can use a suitable tool to lift the third portions of the clips until the lowest parts of the projections 7 are at a higher level than the highest parts of the projections 16 and then the clips can be removed by hammer blows.

The projection 7 of each clip could be formed with a flat horizontal surface 7B extending a short distance from the face 6 towards the fourth portion of the clip (FIGS. 8 to 10), which is thought to reduce the possibility of the projections 16 being sheared off during driving of the clip into its desired position.

I claim:

1. A rail clip, for holding down a railway rail, comprising a rod of resilient metal, at least 8 mm. thick, which has been bent so that it comprises, proceeding from one end of the rod to the other end, a first portion which constitutes a substantially straight leg, a second portion in the form of a reverse bend, a third portion beside the first portion, a fourth portion in the form of a reverse bend and then a fifth portion which terminates at said other end of the rod and is beside the first portion, the configuration being such that when the clip is in a defined position in which the first portion is horizontal and the lowest points at opposite ends of the first portion lie in the same horizontal plane as one another and the lowest points on the third and fifth portions lie in the same horizontal plane as one another, a section of the fourth portion lies vertically above and cross-wise over the axis of the first portion and when the clip is viewed from above the third and fifth portions appear to be on opposite sides of the first portion, the clip further comprising, on the underside of its third portion when the clip is in the defined position, a step having a rising face which faces away from said one end of the rod.

2. A clip according to claim 1 in which the height of the step is less than 4 mm.

3. A clip according to claim 1 in which the height of the step is about 2 mm.

4. A clip according to claim 1 in which the rising face of the step is vertical or nearly vertical when the clip is in the defined position.

5. A clip according to claim 1 in which the length of the rod from which the clip is made is less than 18 times its thickness.

6. A clip according to claim 1 which is such that in the defined position the second portion of the clip, proceeding from the first portion to the third portion, has a rising part followed by a falling part and when the clip is viewed in a horizontal direction parallel to a straight line passing through the lowermost points on the opposite ends of the first portion, said rising part of the second portion is seen to be inclined to the horizontal by, everywhere, less than 45°.

7. A clip according to claim 1 in which the rising face of the step is on one side of a projection which has on its lower side, when the clip is in the defined position, a flat horizontal surface extending a short distance from said face towards the fourth portion of the clip.

8. An assembly on a railway track comprising a railway rail, an anchorage which affords a passageway beside the rail and substantially parallel to the length of it and a clip according to claim 1, the first portion of which has been driven, with said one end of the rod foremost, into the passageway, the third portion of which bears downwardly on a seat which, as seen from the rail, is beyond the passageway and the fifth portion of which bears downwardly on the top of the flange of the rail, said rising face on the clip facing a stop on said seat, the assembly being such that on any attempt to remove the clip solely by hammer blows in the direction opposite to that in which the first portion of the clip has been driven into the passageway, said rising face on the clip abuts said stop so that such removal of the clip is prevented.

9. An assembly according to claim 8 in which the stop is formed by a blob of weld on the seat.

* * * * *